US011660493B2

(12) United States Patent
Saar

(10) Patent No.: US 11,660,493 B2
(45) Date of Patent: May 30, 2023

(54) FOOT HARNESS FOR LOWER BODY CABLE MACHINE EXERCISES

(71) Applicant: Robert Jeffrey Saar, Irvine, CA (US)

(72) Inventor: Robert Jeffrey Saar, Irvine, CA (US)

( * ) Notice: Subject to any disclaimer, the term of this patent is extended or adjusted under 35 U.S.C. 154(b) by 269 days.

(21) Appl. No.: 15/723,066

(22) Filed: Oct. 2, 2017

(65) Prior Publication Data

US 2018/0078813 A1 Mar. 22, 2018

Related U.S. Application Data

(63) Continuation-in-part of application No. 15/166,150, filed on May 26, 2016, now Pat. No. 9,821,189.

(60) Provisional application No. 62/437,573, filed on Dec. 21, 2016.

(51) Int. Cl.

| | |
|---|---|
| ***A63B 21/16*** | (2006.01) |
| ***A63B 21/00*** | (2006.01) |
| ***A43B 5/00*** | (2022.01) |
| ***A63B 23/04*** | (2006.01) |
| ***A43B 5/18*** | (2006.01) |

(52) U.S. Cl.

CPC ..... *A63B 21/4015* (2015.10); *A43B 5/00* (2013.01); *A43B 5/18* (2013.01); *A63B 21/15* (2013.01); *A63B 21/4011* (2015.10); *A63B 23/04* (2013.01); *A63B 2209/00* (2013.01); *A63B 2209/10* (2013.01); *A63B 2225/096* (2013.01)

(58) Field of Classification Search

CPC .. A63B 21/4013; A63B 21/4015; A63B 23/08

USPC ..... 482/79

See application file for complete search history.

(56) References Cited

U.S. PATENT DOCUMENTS

| | | | | | |
|---|---|---|---|---|---|
| 4,728,103 | A * | 3/1988 | Fulton | A63B 23/085 | 482/125 |
| 5,186,701 | A * | 2/1993 | Wilkinson | A63B 21/00065 | 482/121 |
| 5,203,754 | A * | 4/1993 | Maclean | A63B 21/4015 | 482/121 |
| 5,647,827 | A * | 7/1997 | Gutkowski | A63B 21/4025 | 482/122 |
| 7,628,742 | B2 * | 12/2009 | Weaver | A63B 21/4025 | 482/125 |
| 2004/0147378 | A1 * | 7/2004 | Conklin | A63B 21/169 | 482/124 |
| 2006/0265910 | A1 * | 11/2006 | Lampley | A43B 19/005 | 36/132 |
| 2007/0191193 | A1 * | 8/2007 | Backes | A61H 1/0266 | 482/79 |
| 2010/0050473 | A1 * | 3/2010 | Rosso | A63B 21/154 | 36/105 |
| 2016/0101309 | A1 * | 4/2016 | Schreiber | A63B 21/0442 | 482/124 |
| 2016/0256732 | A1 * | 9/2016 | Kasner | A63B 23/1281 | |

(Continued)

*Primary Examiner* — Joshua T Kennedy

(74) *Attorney, Agent, or Firm* — Saliwanchik, Lloyd & Eisenschenk

(57) ABSTRACT

A foot or leg harness is disclosed for use with a means of resistance. The harness provides improved muscle activation for lower body exercises. The foot or leg harness includes a harness portion to attach user. The harness is designed to attach to a means of resistance. The point of resistance is distributed into the harness through an angular strap portion so that resistance for the exercise is encompassing the foot or leg as a unit rather than one particular area.

18 Claims, 15 Drawing Sheets

(56) References Cited

U.S. PATENT DOCUMENTS

| | | | | |
|---|---|---|---|---|
| 2016/0345656 | A1* | 12/2016 | Ramirez, II | A63B 21/4043 |
| 2018/0036577 | A1* | 2/2018 | Leary | A63B 21/00185 |
| 2018/0200559 | A1* | 7/2018 | Papashvili | A63B 21/4025 |
| 2019/0126091 | A1* | 5/2019 | Griffin | A43B 3/16 |

* cited by examiner

FOOT HARNESS FOR LOWER BODY CABLE MACHINE EXERCISES

CROSS-REFERENCE TO RELATED APPLICATIONS

This is a continuation-in-part of U.S. application Ser. No. 15/166,150, filed, with title "Foot Harness for Lower Body Cable Machine Exercises" and naming Robert Jeffrey Saar as inventor(s) the entire content of which is hereby incorporated herein by reference. This continuation-in-part also claims benefit under 35 U.S.C. § 119(e) of U.S. Provisional Application Ser. No. 62/437,573 filed Dec. 21, 2016, which is hereby incorporated by reference herein in its entirety.

BACKGROUND

The embodiments herein relate generally to fitness equipment, and more particularly, to a foot harness for lower body resistance based work.

When working the posterior chain of the human body, mobility optimization, as well as neuro efficiency is very critical. Current devices don't properly encapsulate and stabilize the foot, other devices will ride up the user's leg. Some foot harnesses attach from a ring at the front of the ankle or directly from the top of the foot. In other cases straps will extend off the foot harness at a perpendicular angle, causing an un-natural pull on the users foot. Thus, such devices do not correctly engage the necessary proprioception of the human nervous system. The point of resistance is un-naturally placed on the foot or lower leg and maximum targeting of the lower body is not realized during cable based exercises.

As can be seen, there is a need for a foot or leg harness that provides the user improved use of foot and leg strength during resistance based work. In conjunction with optimized force vectors in relation to the harness resistance attachment point placement, and angle of supporting harness member or members.

SUMMARY

According to one embodiment, a foot harness for wearing on a foot during resistance based work comprises a harness support member configured to contact a users foot. An angular harness portion including a predetermined or an adjustable angle, and a means for attaching said foot harness to a form of resistance. Wherein the harness support member attaches users foot to a form of resistance through the angular harness portion and the means of attachment, whereby the foot harness supports substantial means for users foot loading potential.

BRIEF DESCRIPTION OF THE FIGURES

The detailed description of some embodiments of the present invention is made below with reference to the accompanying figures, wherein like numerals represent corresponding parts of the figures.

DETAILED DESCRIPTION OF CERTAIN EMBODIMENTS

Figure 1:
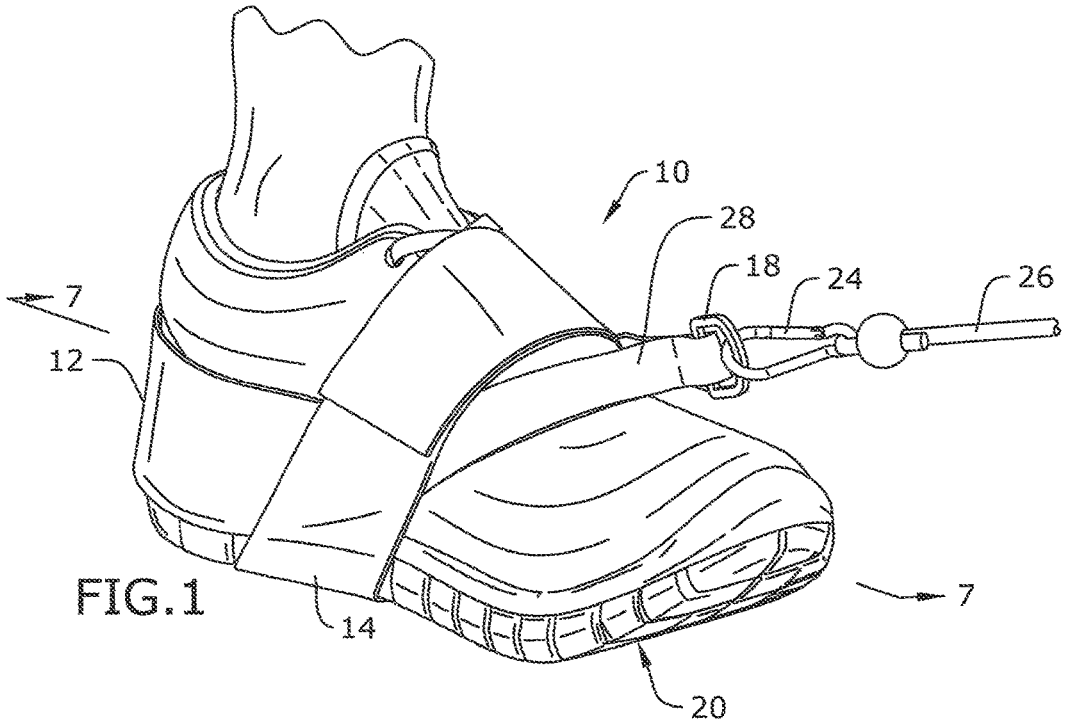
FIG. 1 is a front perspective view of a foot harness in use with the foot planar to the floor in accordance with an exemplary embodiment of the subject technology.
Figure 2:
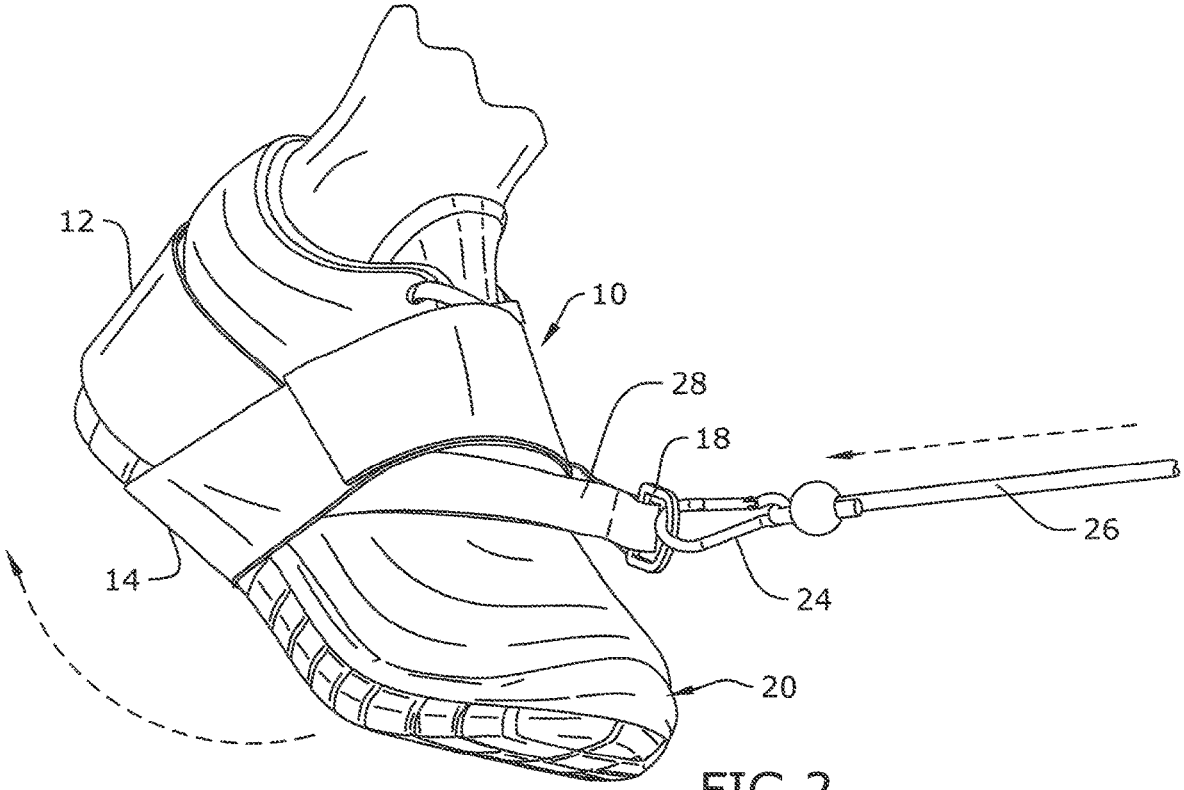
FIG. 2 is a front perspective view of the foot harness of FIG. 1 in use with a heel of the foot flexed upward from the floor during a kickback motion.
Figure 3:
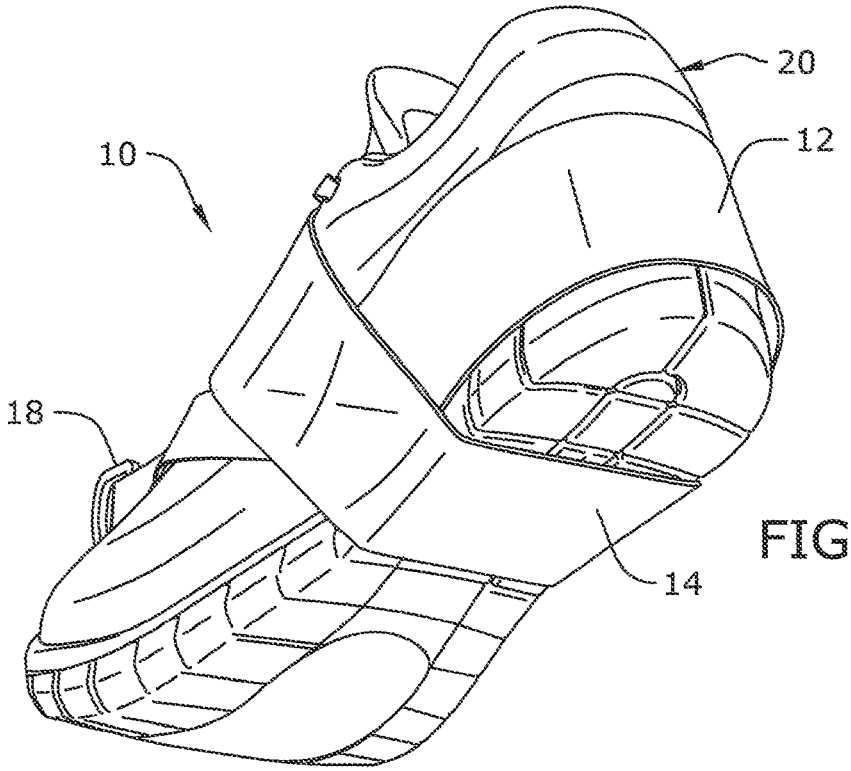
FIG. 3 is a rear perspective view of the foot harness of FIG. 2 in use.
Figure 4:
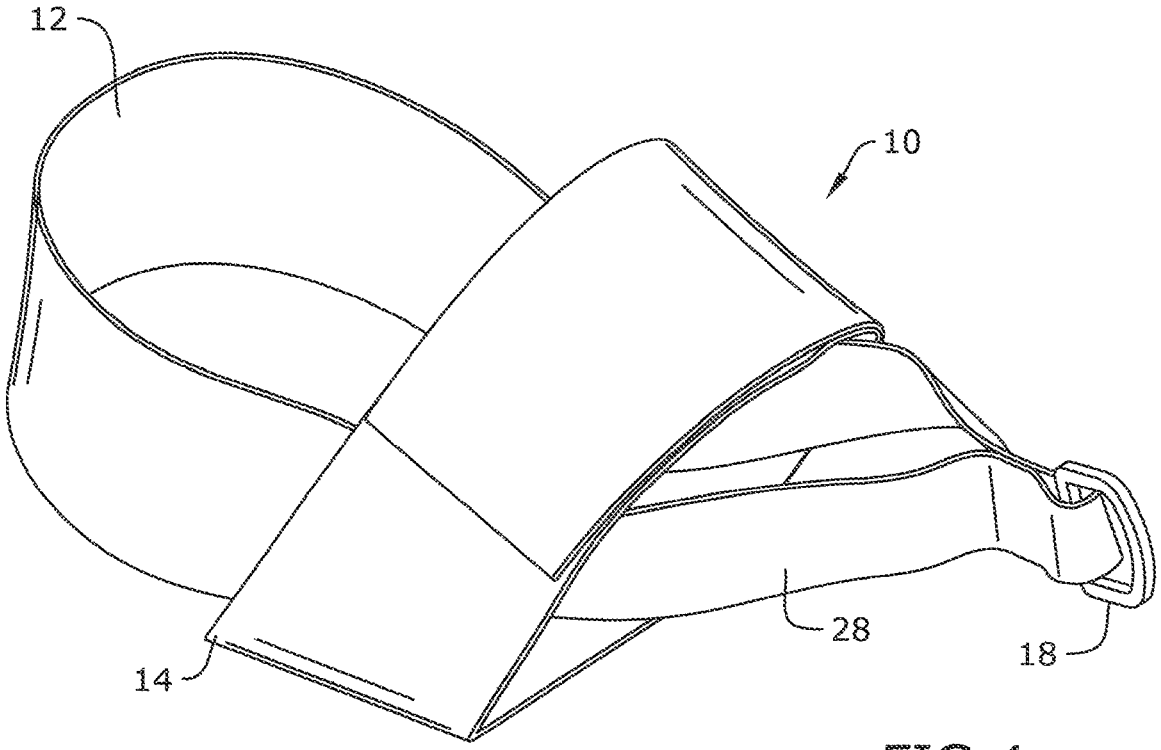
FIG. 4 is a front, side perspective view of the foot harness of FIG. 1.
Figure 5:
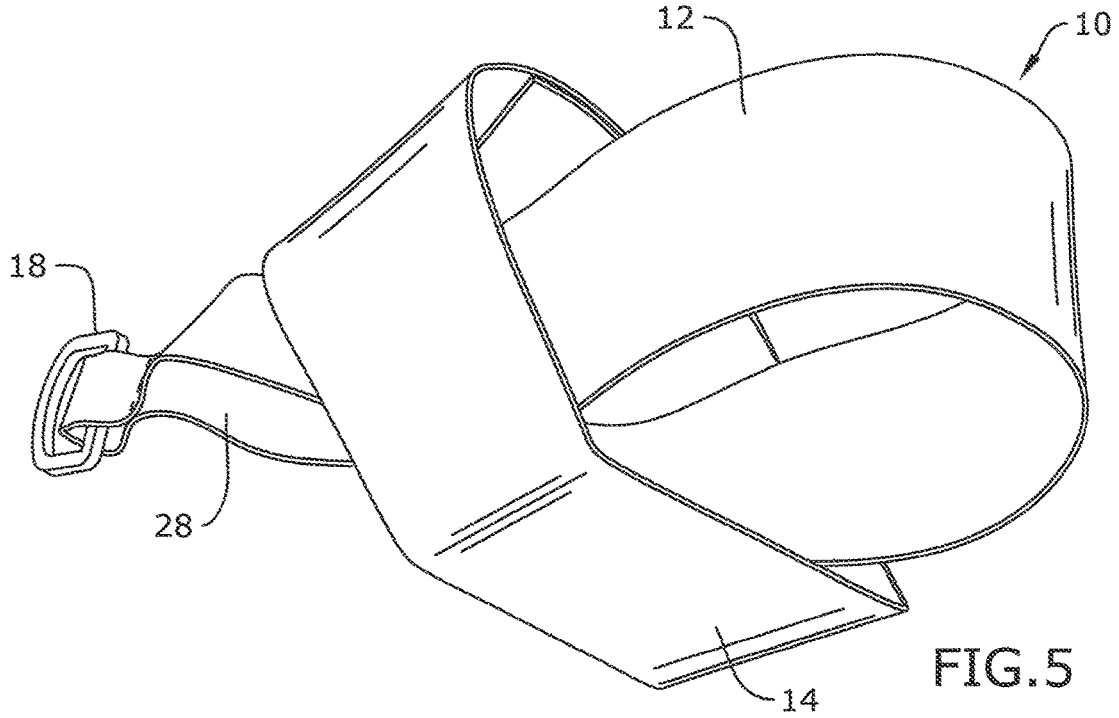
FIG. 5 is a rear, side perspective view of the foot harness of FIG. 4.
Figure 6:
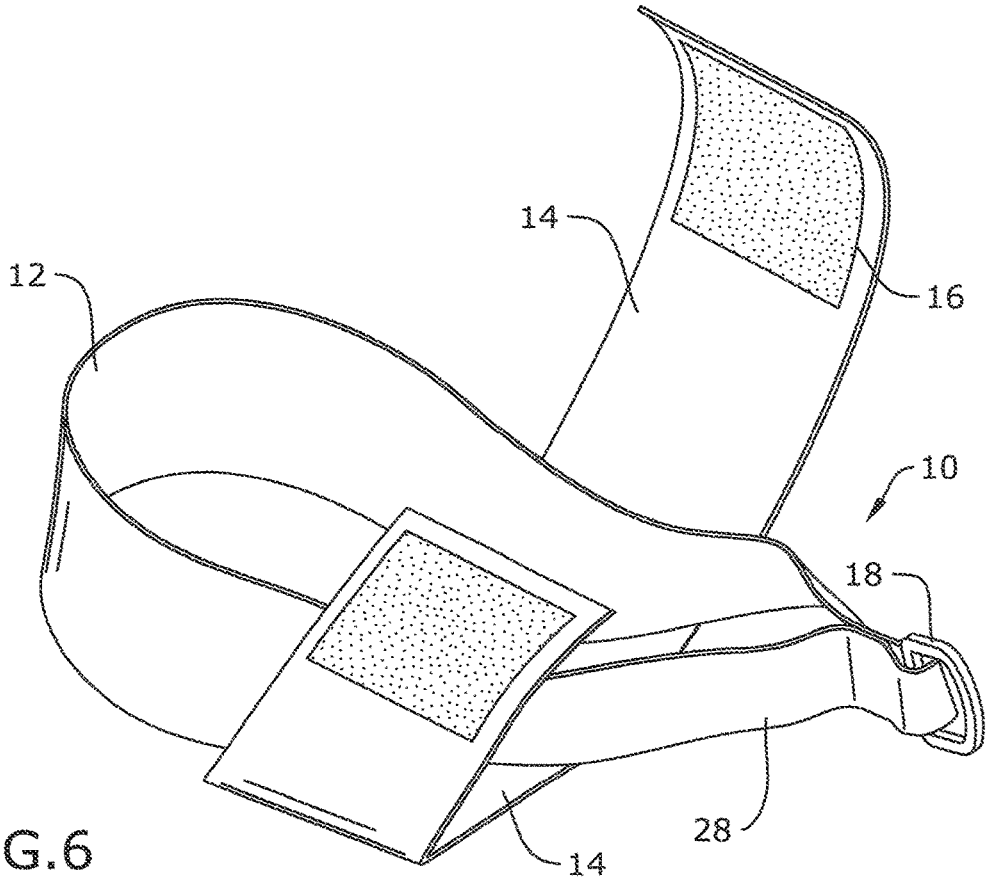
FIG. 6 is a front, side perspective view of the foot harness of FIG. 4 with a sole strap in an open position.
Figure 7:
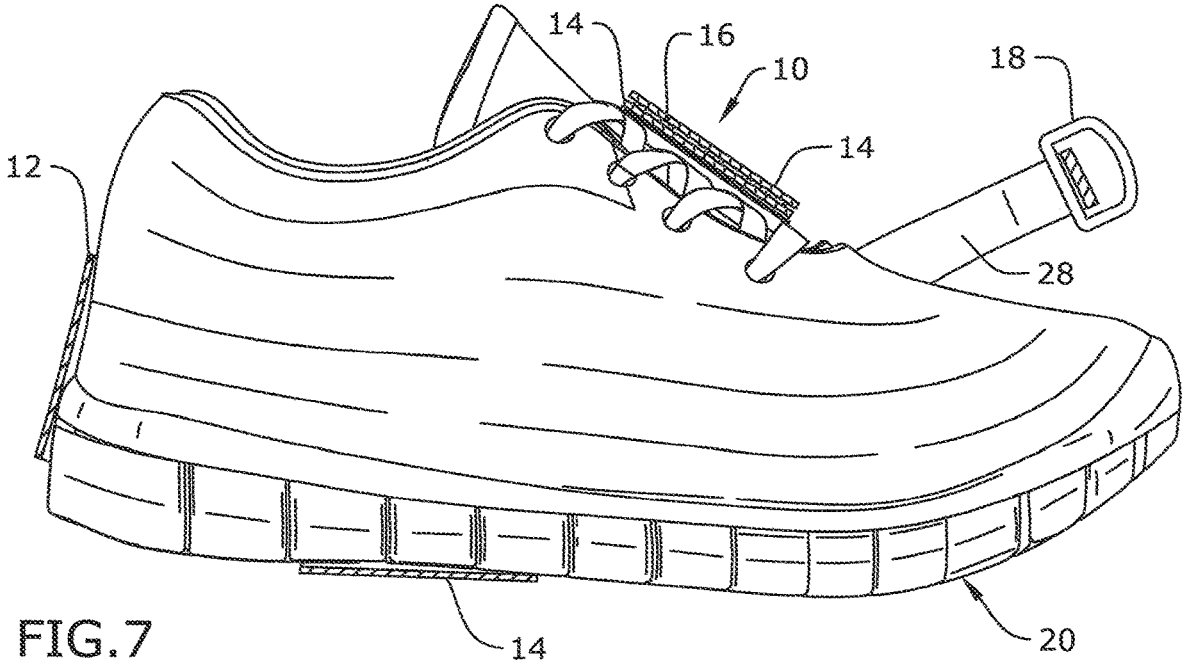
FIG. 7 is a cross-sectional view taken along the line 7-7 of FIG. 1.

The word "exemplary" is used herein to mean "serving as an example or illustration." Any aspect or design described herein as "exemplary" is not necessarily to be construed as preferred or advantageous over other aspects or designs.

By way of example, and referring to FIGS. 1-7, an embodiment of the subject technology comprises a foot harness 10. As will be appreciated, aspects of the foot harness 10 focus the point of resistance for resistance based exercises to the foot, through angular strap based attachment system, unlike prior art harnesses which place the resistance on the users foot through perpendicular straps. The foot harness 10 includes a heel strap 12 and a sole strap 14. The straps 12 and 14 may be fabric based. In an exemplary embodiment, the heel strap 12 includes a rear portion looping around the heel of a shoe 20 and a front portion comprising strap ends 28 projecting forward of the heel section and up at an angle from a plane of the sole of the shoe. In some embodiments, the front portion and the rear portion may be two pieces attached together or may be one piece with the front portion attached to the sole strap 14 to rise at an angle. In some embodiments, a high friction lining may line an interior surface of the straps to aid the user in maintaining a proper position and traction within the harness 10 during operation. The straps ends 28 rise up from an intersection where the heel strap 12 attaches to the sole strap 14. In an exemplary embodiment, when the harness 10 is worn over the shoe 20, the strap ends 28 are attached or assembled at an angle to elevate above the shoe's vamp section as a fastener 18 (for example, a D-ring) is attached to a carabiner 24 of a cable 26 attached to a cable exercise machine (not shown).

The sole strap 14 may be configured to loop around the sole of the shoe 20 and over the shoe's upper, this strap may also include one of a plurality of attachment points. In some embodiments, the sole strap 14 may include a flattened bottom section 60 for positioning under the sole of a shoe, so that the harness 1O makes planar contact with the sole when used. The sole strap 14 may be open ended above the upper and may include a hook and loop fastener system 16 to secure the sole strap 14 to the shoe 20.

As will be appreciated, the foot harness 10 directs full possible neuro energy to the involved major muscle groups, through proper stabilization, mobility, and decreased pain perception of the human foot. The angle of the strap ends 28 attached or assembled at an angle, which allows for a natural full range of possible motion. When connected to the cable 26, the point of resistance is moved down into the sole of the shoe 20 where the foot may push against the sole strap 14 and heel strap 12 rather than pull at the ankle or un-naturally pull the users foot at or near the point of attachment. The harness 10 may be especially useful for movements to train and isolate the lower posterior (back of the body) musculature of the human body including for example, the gluteus and hamstring muscles. The mid-foot mounted lower sole strap 14 locates the heel strap 12 to correct vertical placement of the user's foot. The mid-foot positioned strap ends 28 on the top of the foot urge the user's foot to remain seated against heel strap 12. Indirect work will be associated with the low back and associated torso extensors. In addition, the foot harness 10 may also allow users to safely and efficiently perform leg adduction movements, as well as leg abduction movements, as the mid-foot positioned and angled strap ends 28 expose the users foot and leg to natural feeling rotational forces during lateral lower body work. This resulting foot rotation provides an improved stability at the users ankle, knee, and associated joints in relation to the ankle and knee. This is due to the rotational forces stimulating proprioception of the associated calf musculature, which then provides the user improved leg, and associated leg joint support.

Figure 8:
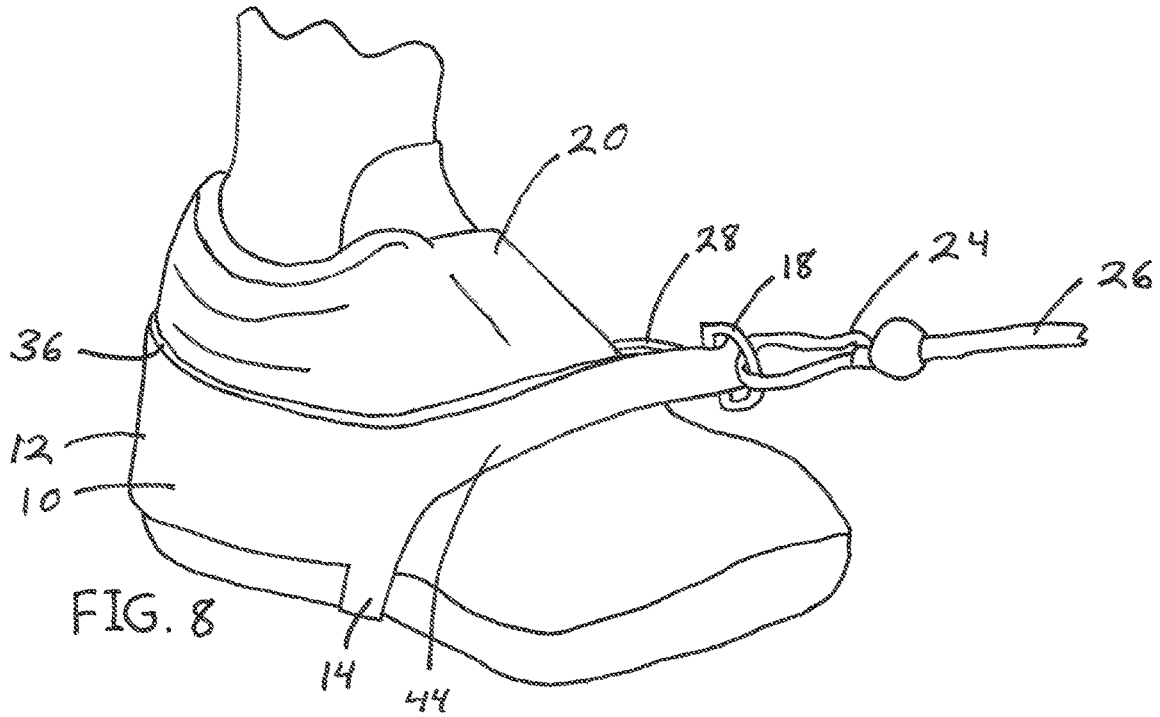
FIG. 8 is a front perspective view of a foot harness in use with the foot planar to the floor in accordance with an exemplary embodiment of the subject technology.

By way of example, and referring to FIG. 8, an embodiment of the subject technology comprises a foot harness 10. As will be appreciated, aspects of the foot harness 10 focus the point of resistance for resistance based work to the foot, through an angular harness portion 44, unlike prior art harnesses which place the resistance on the users foot through perpendicular straps which may cause an un-natural torque on the users foot during use. In an exemplary embodiment foot harness 10 includes a heel support member 12 and a sole support member 14 located near the mid foot portion of the sole of the shoe 20, the heel strap 12 portion includes a rear portion looping around the heel of a shoe 20 and a front portion comprising an attachment point support member 28 projecting forward and upward at an angle from a plane of the sole of the shoe. In an exemplary embodiment, when the harness 10 is worn over the shoe 20, the attachment point support members 28 are attached or constructed at an angle to elevate on or above the shoe's vamp section as an attachment point 18 (for example, a D-ring) is attached to a carabiner 24 of a cable 26 attached to a cable exercise machine (not shown). In some embodiments, foot harness 10 may be constructed of one material type or a plurality of material types may be utilized, foot harness 10 may be constructed as one piece, or construction may consist of a plurality of pieces.

Figure 9:
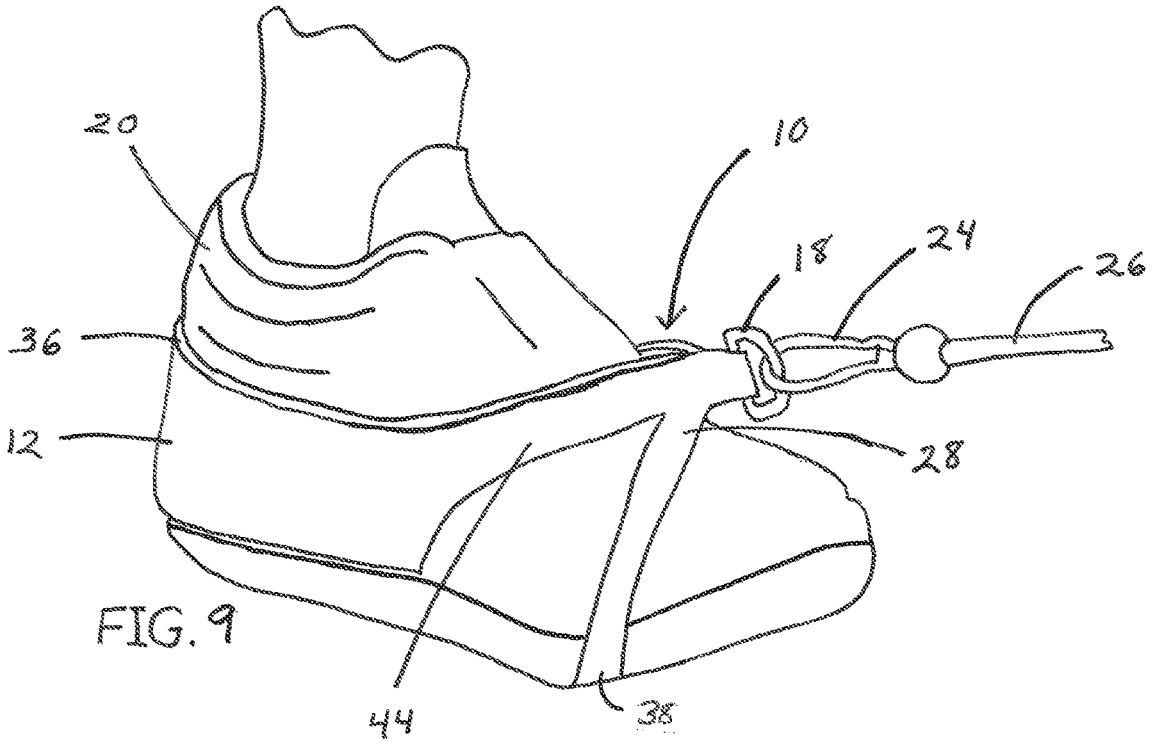
FIG. 9 is a front perspective view of a foot harness in use with the foot planar to the floor in accordance with an exemplary embodiment of the subject technology.

By way of example, and referring to FIG. 9, an embodiment of the subject technology comprises a foot harness 10. As will be appreciated, aspects of the foot harness 10 focus the point of resistance for resistance based work to the foot, through an angular harness portion 44, unlike prior art harnesses which place the resistance on the users foot through perpendicular straps which may cause an un-natural torque on the users foot during use. In an exemplary embodiment foot harness 10 includes a heel support member 12 and a forefoot sole support member 38 located at the forefoot portion of the users foot, forefoot sole support member 38 works in combination with heel support member 12 to bias the load on the users foot. In an exemplary embodiment, the heel support member 12 includes a rear portion looping around the heel of a shoe 20 and a front portion comprising attachment point support member 28 projecting forward and upward at an angle from a plane of the sole of the shoe. In an exemplary embodiment, when the harness 10 is worn over the shoe 20, the attachment point support member 28 is attached or constructed at an angle to elevate on or above the shoe's vamp section as a fastener 18 (for example, a D-ring) is attached to a carabiner 24 of a cable 26 attached to a cable exercise machine (not shown). In some embodiments, foot harness 10 may be constructed of one material type or a plurality of material types may be utilized, foot harness 10 may be constructed as one piece, or construction may consist of a plurality of pieces.

Figure 10:
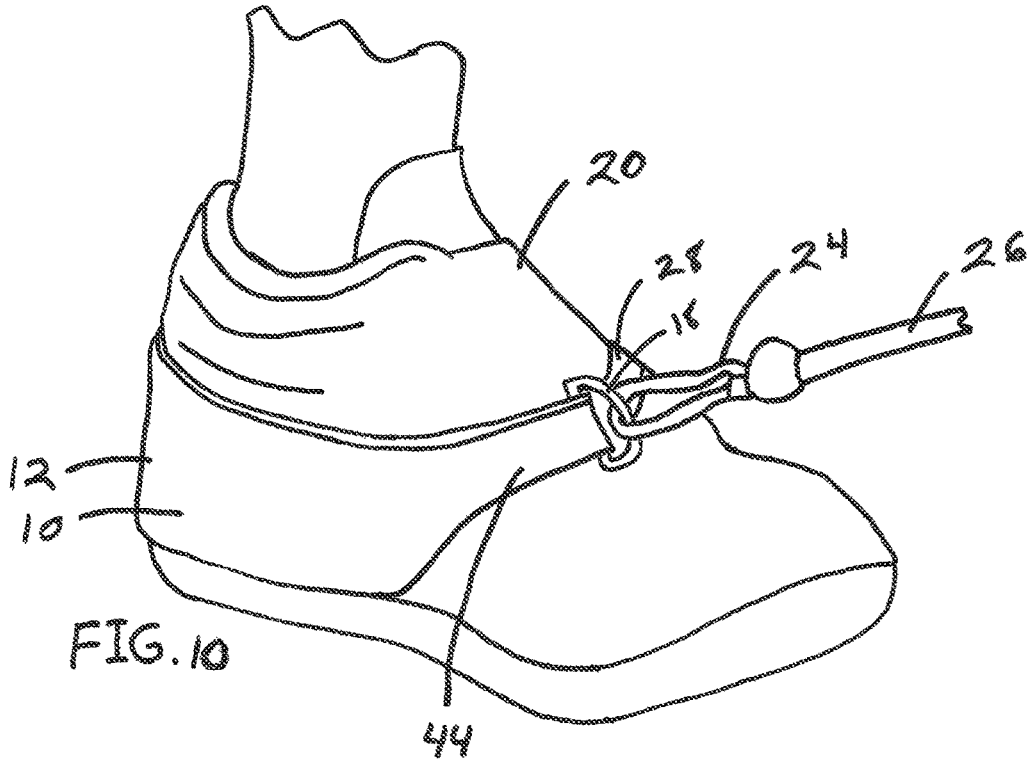
FIG. 10 is a front perspective view of a foot harness in use with the foot planar to the floor in accordance with an exemplary embodiment of the subject technology.

By way of example, and referring to FIG. 10, an embodiment of the subject technology comprises a foot harness 10. As will be appreciated, aspects of the foot harness 10 focus the point of resistance for resistance based work to the heel portion of the users foot through angular construction, unlike prior art harnesses which place the resistance on the users foot through perpendicular straps. In an exemplary embodiment foot harness 10 includes a heel support member 12, an angular harness portion 44, and attachment point support members 28 of which collectively converge to form the base for attachment point 18. The foot harness 10 may not need a closed or closable section in addition to the attachment point support members 28 to keep the foot harness 10 in place on the users foot or shoe. In an exemplary embodiment, the heel support member 12 includes a portion looping around the heel of a shoe 20 and a front portion comprising strap ends 28 projecting both forward at an angle upwards in relation to the shoe 20 sole. In some embodiments, foot harness 10 may be constructed of one material type or a plurality of material types may be utilized, foot harness 10 may be constructed as one piece, or construction may consist of a plurality of pieces.

Figure 11:
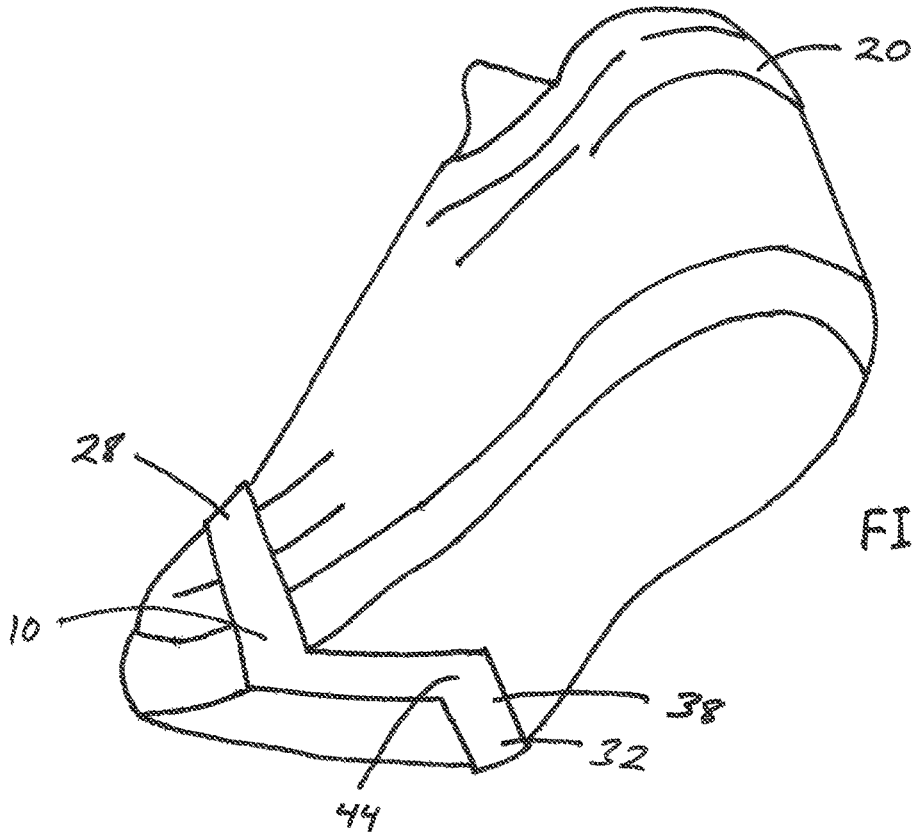
FIG. 11 is a rear perspective view of the foot harness in use in accordance with an exemplary embodiment of the subject technology.

By way of example, and referring to FIG. 11, an embodiment of the subject technology comprises a foot harness 10. As will be appreciated, aspects of the foot harness 10 focus the point of resistance for resistance based work to the forefoot portion of the users foot, through an angular harness portion 44, unlike prior art harnesses which place the resistance on the users forefoot through perpendicular straps. In an exemplary embodiment foot harness 10 includes a forefoot sole support member 38 which is of angular or curved construction to conform to the users shoe 20, to enhance loading bias and load distribution potential. In some embodiments foot harness 10 may include a high friction surface 32 to prevent users shoe 20 or foot from slipping on floor during use in certain environments, unlike prior art harnesses which may slide on the floor. In some embodiments, foot harness 10 may be constructed of one material type or a plurality of material types may be utilized, foot harness 10 may be constructed as one piece, or construction may consist of a plurality of pieces.

Figure 12:
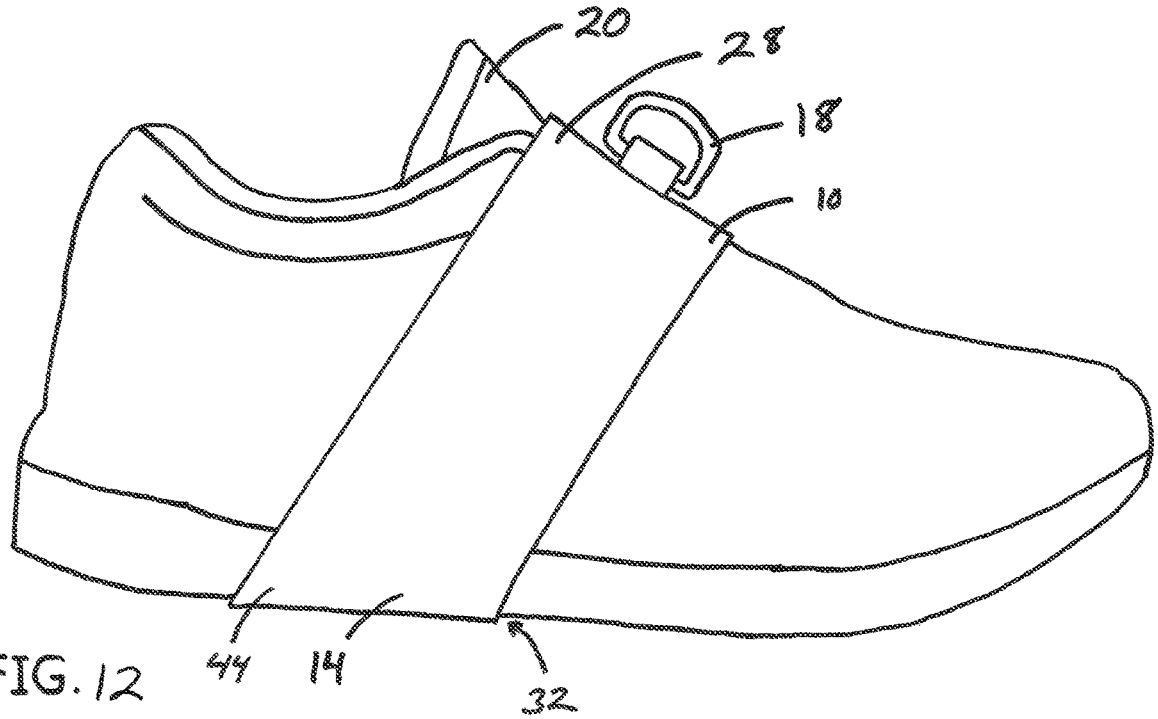
FIG. 12 is a side view of a foot harness in use with the shoe planar to the floor in accordance with an exemplary embodiment of the subject technology.

By way of example, and referring to FIG. 12, an embodiment of the subject technology comprises a foot harness 10. As will be appreciated, aspects of the foot harness 10 focus the point of resistance for resistance based work to the users foot, through an angular harness portion 44, unlike prior art harnesses which place the resistance on the users forefoot through perpendicular straps. In an exemplary embodiment an attachment point support member 28 contains a mounting surface for an attachment point 18, this provides means for foot harness 10 to be coupled to resistance, for resistance based work, sole support member 14 loops around shoe 20 to provide support for the attachment support member 28. In some embodiments, foot harness 10 may include a high friction surface 32, and a multitude of attachment points and a multitude of various support members and configurations. In some embodiments, foot harness 10 may be urged into place by user or comprise an alternate mechanical means of fastening system to locate foot harness 10 in the desired area on users foot. In some embodiments, foot harness 10 may be constructed of one material type or a plurality of material types may be utilized, foot harness 10 may be constructed as one piece, or construction may consist of a plurality of pieces.

Figure 13:
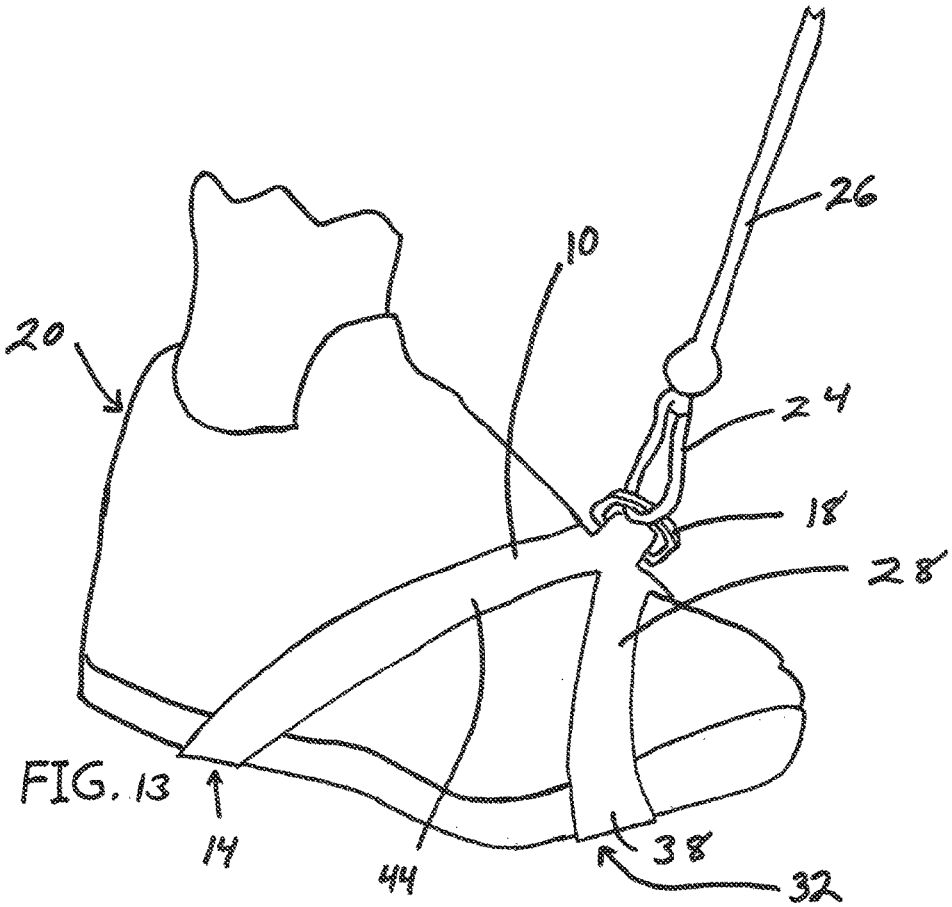
FIG. 13 is a front perspective view of a foot harness in use with the foot planar to the floor in accordance with an exemplary embodiment of the subject technology.

By way of example, and referring to FIG. 13, an embodiment of the subject technology comprises a foot harness 10. As will be appreciated, aspects of the foot harness 10 focus the point of resistance for resistance based work to the forefoot portion of the users foot, through an angular harness portion 44, unlike prior art harnesses which place the resistance on the users foot through perpendicular straps. In an exemplary embodiment sole support member 14 loops around the mid foot portion of the sole of shoe 20, forefoot sole support member 38 loops around the forefoot portion of the sole of shoe 20, the two sole support members project upwards from the base of the shoe 20 sole and converge at an angle to combine together over the top of the shoe 20 to form the attachment point support member 28, which provides means of mounting attachment point 18. The forefoot sole support member 38 and the sole support member 14 working in concert provide a balanced and stable loading on the users foot. In some embodiments foot harness 10 may include a high friction surface 32 to prevent users shoe 20 or foot from slipping on floor during use in certain environments, unlike prior art harnesses which may slide on the floor. In some embodiments a multitude of support members and attachment points may be added to the foot harness 10 configuration. In some embodiments, foot harness 10 may be constructed of one material type or a plurality of material types may be utilized, foot harness 10 may be constructed as one piece, or construction may consist of a plurality of pieces.

Figure 14:
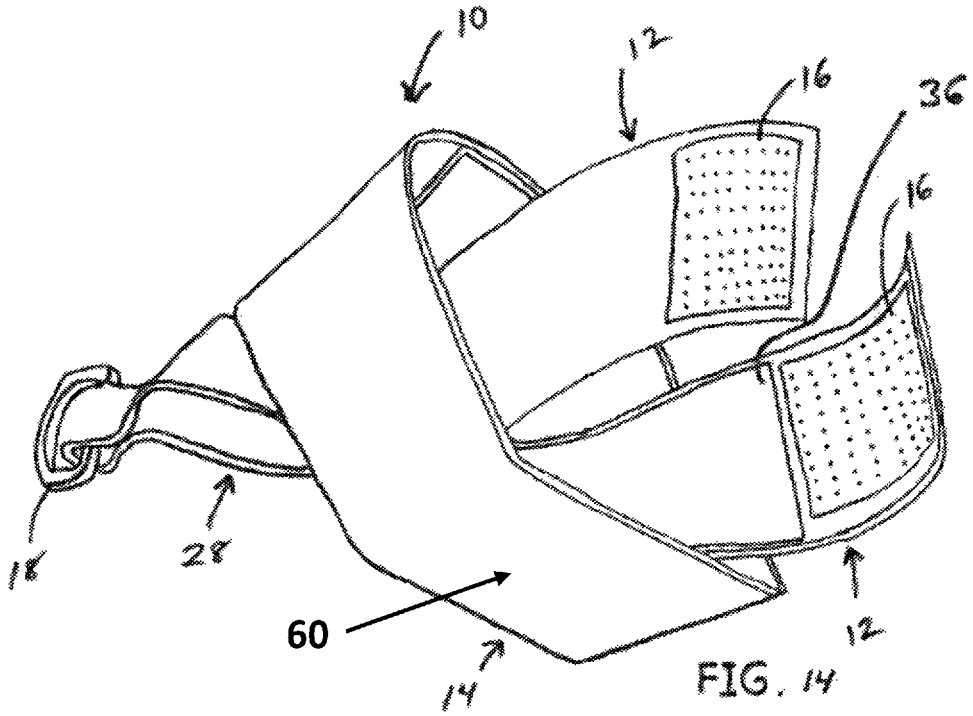
FIG. 14 is a rear, side perspective view of the foot harness in accordance with an exemplary embodiment of the subject technology.

By way of example, and referring to FIG. 14, an embodiment of the subject technology comprises a foot harness 10. As will be appreciated, aspects of the foot harness 10 include heel support members 12 with an adjustable or releasable portion, unlike prior art harnesses which utilize a fixed or closed heel support member 12. In an exemplary embodiment the heel support member 12 including an adjustable or releasable portion, where the said user is offered adjustment or opening of said heel support member portion in gaining preferred adjustment or access to foot harness 10, where the heel support member 12 can be substantially configured to accommodate the user. Heel support members 12 allow a point of access to improve the design aspect within a foot harness 10 through allowing the higher stressed areas to be designed of simple, less complex members which in turn may allow them to be lighter, or smaller, or more streamlined while maintaining the desired harness strength and rigidity, the heel support member may be substantially configured to accommodate user convenience and achieve desired performance from said foot harness. This heel support member 12 access point allows a foot harness 10 to be designed wherein the harness maintains or improves accommodation of various size feet or styles of footwear, where user is offered adjustment in gaining preferred adjustment and access to foot harness 10, which allows the foot harness 10 design to substantially accommodate user and more potential foot harness 10 design solutions. In an exemplary embodiment, the Velcro 16 secures the heel support members 12 together, and includes an adhesive backed high friction lining 36, when user urges their foot into the fixed heel support members 12, mating surfaces of the Velcro 16 become pressed together by the users force, encouraging heel support members 12 strength and rigidity. In some embodiments, the heel support member 12 or members 12 may be constructed at an angle or curve to more closely match the contours of the users foot or footwear, in others the heel support member 12 or members 12 may also loop around a portion of the sole. The heel support member 12 may be secured using an alternate means of a fastening system. The heel support member 12 may be one or a plurality of adjustable or releasable members. In some embodiments, foot harness 10 may be constructed of one material type or a plurality of material types may be utilized, foot harness 10 may be constructed as one piece, or construction may consist of a plurality of pieces.

Figure 15:
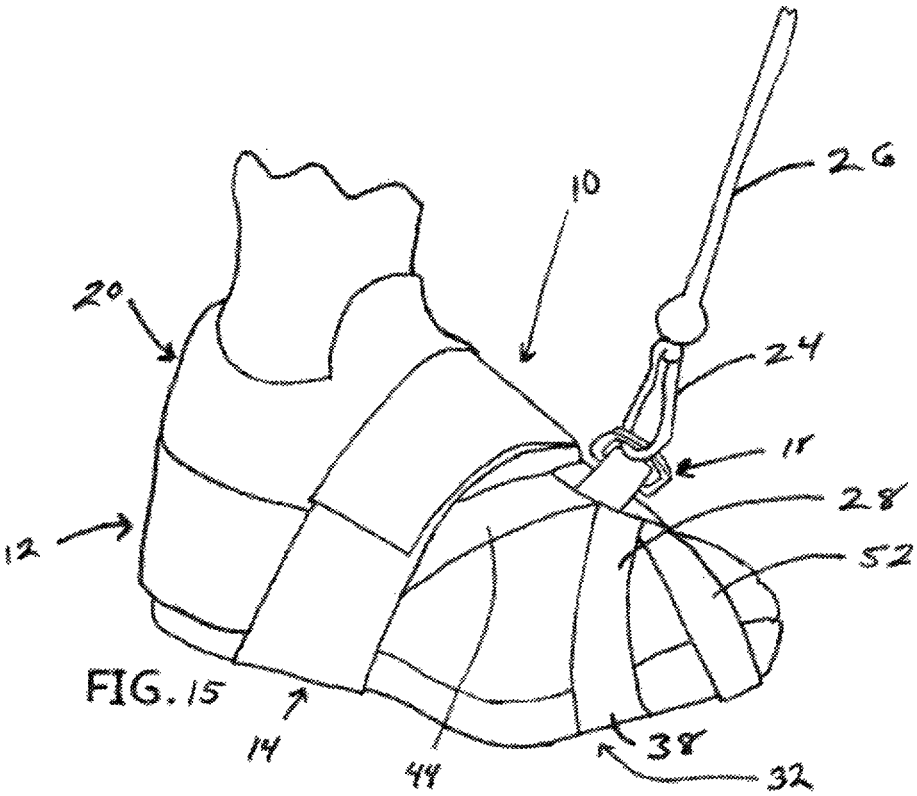
FIG. 15 is a front perspective view of a foot harness in use with the foot planar to the floor in accordance with an exemplary embodiment of the subject technology.
Figure 16:
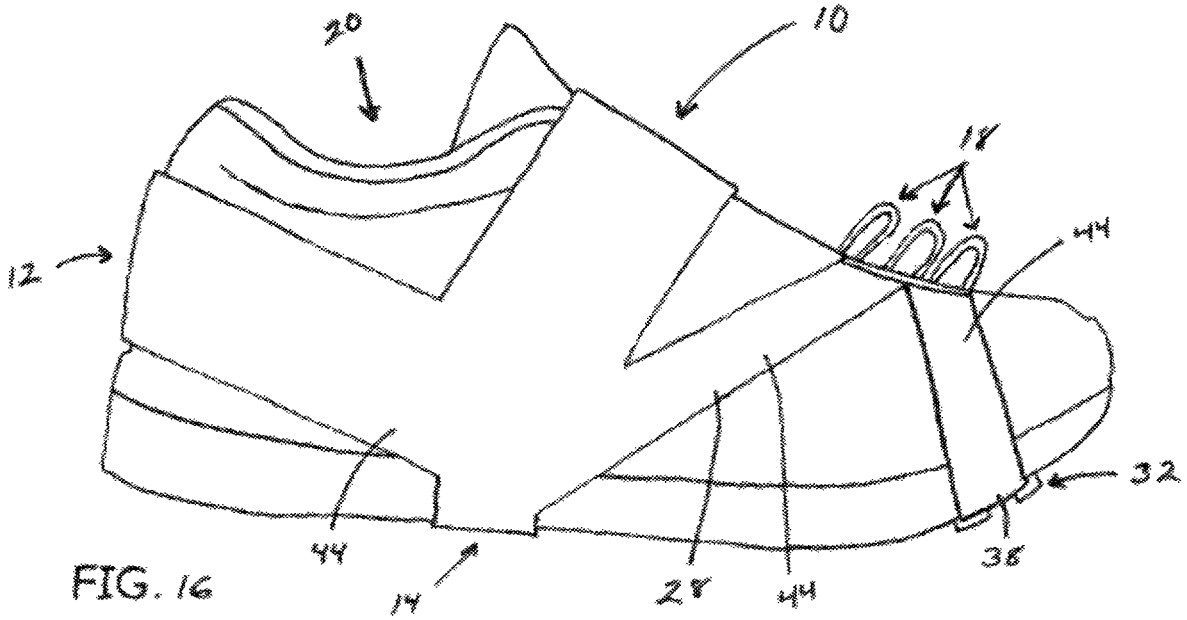
FIG. 16 is a side view of a foot harness in use with the shoe planar to the floor in accordance with an exemplary embodiment of the subject technology.
Figure 17:
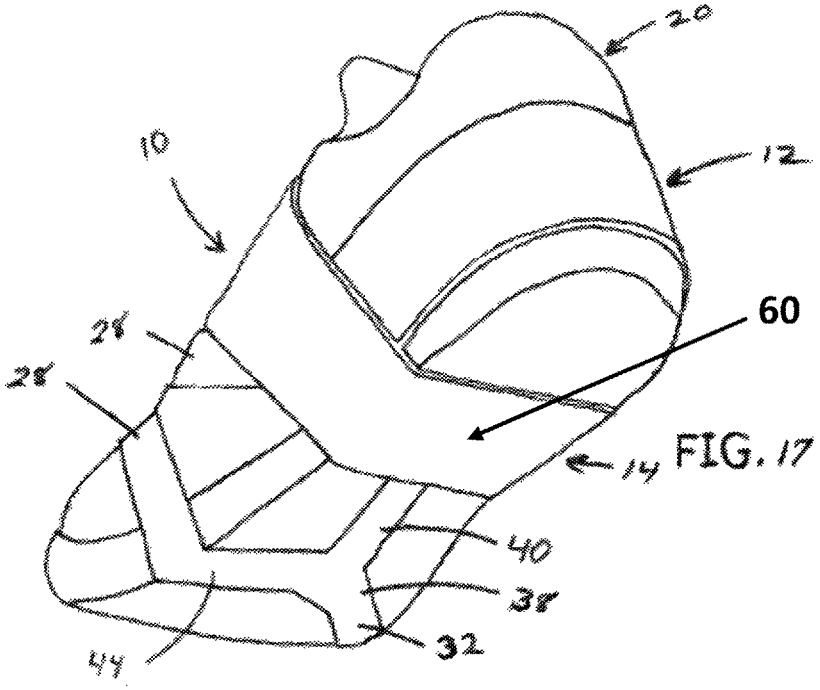
FIG. 17 is a rear perspective view of the foot harness in use in accordance with an exemplary embodiment of the subject technology.

By way of example, and referring to FIGS. 15-17, an embodiment of the subject technology comprises a foot harness 10. As will be appreciated, aspects of the foot harness 10 focus the point of resistance for resistance based work to the forefoot portion of the users foot, through angular harness portion 44, unlike prior art harnesses which place the resistance on the users forefoot through perpendicular straps. In an exemplary embodiment, foot harness 10 includes a heel support member 12, a sole support member 14, and a forefoot sole support member 38 which mates to the mid sole support member 40 where they are of angular or curved construction to conform to the users forefoot portion. The heel support member 12 includes a portion looping around the heel of a shoe 20 and a front portion comprising attachment point support members 28 comprising an angular harness portion to link with attachment point support members 38, the forefoot sole support member 38 loops around the forefoot of the users sole and comes back at an angle towards the users mid foot portion to mate more closely to the shoes 20 curved forefoot portion. The upper portion of the forefoot sole support member 38 meet as the attachment point support members 28 with an angular harness portion 44 and curved construction; this construction of foot harness 10 on the front portion sole strap 38 is to better fit the desired forefoot portion. The forefoot sole support member 38 and the sole support member 14 are linked together by angular mid sole support member 40 to comprise a balanced loading base for users foot. In some embodiments foot harness 10 may include a high friction surface 32 to prevent users shoe 20 or foot from slipping on floor during use in certain environments, unlike prior art harnesses which may slide on the floor. In some embodiments a toe support member 52, or a plurality of toe support members 52 may be added to foot harness 10. In some embodiments the foot harness 10 may include a more basic attachment point 18, in some embodiments foot harness 10 may include a plurality of attachment points 18 for various desired vectors of load bias to the users foot. FIG. 16 displays a proximity of these attachment points 18 where they may also be setup on a support member as such that they may be used for the purpose of sharing a load bias from a form of resistance, where proximity of these attachment points is such that multiple attachment points may be utilized in concert to provide user a split load biasing effect, using a combination of the attachment points 18 at one time, or the user can opt to using just one; which may be an aid in advanced level resistance based work by providing a plurality of harness loading options. In some embodiments, foot harness 10 may be constructed of one material type or a plurality of material types may be utilized, foot harness 10 may be constructed as one piece, or construction may consist of a plurality of pieces.

Figure 18:
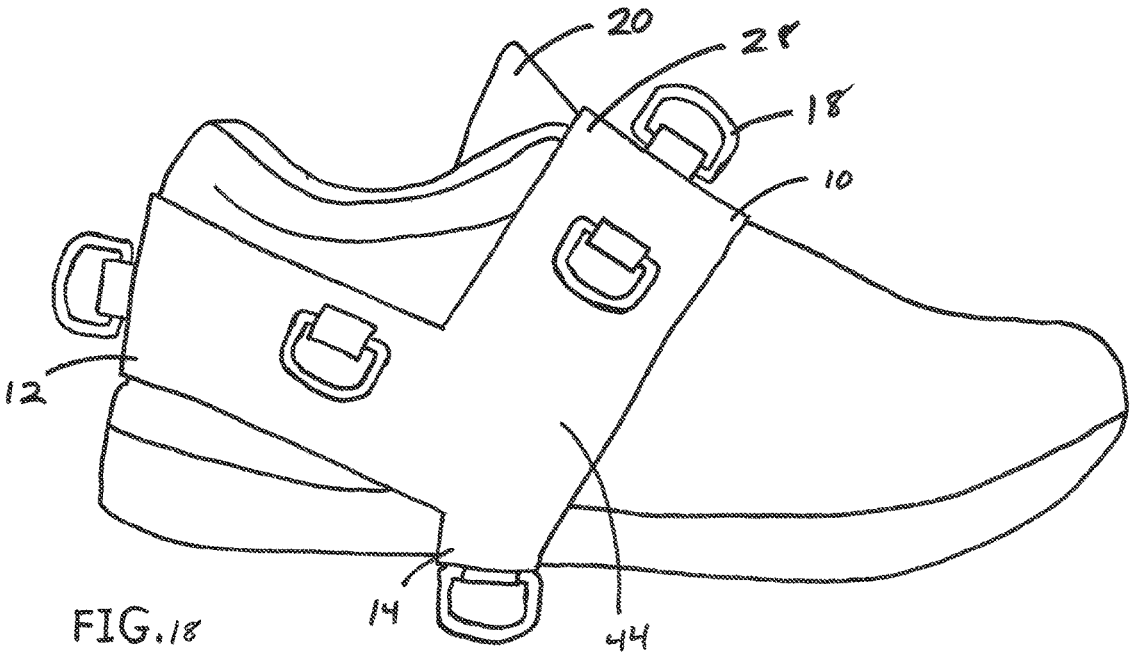
FIG. 18 is a side view of a foot harness in use with the shoe planar to the floor in accordance with an exemplary embodiment of the subject technology.
Figure 19:
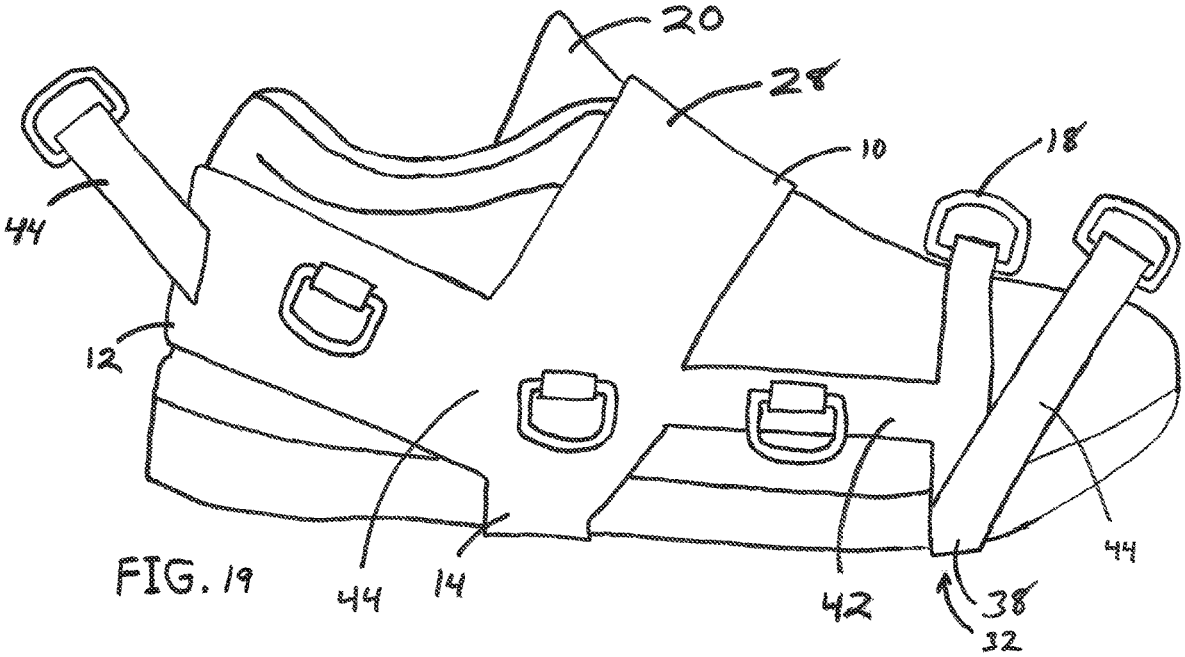
FIG. 19 is a side view of a foot harness in use with the shoe planar to the floor in accordance with an exemplary embodiment of the subject technology.

By way of example, and referring to FIGS. 18 and 19, an embodiment of the subject technology comprises a foot harness 10. As will be appreciated, aspects of the foot harness 10 focus the point of resistance for resistance based work to the users foot, through an angular harness portion 44, unlike prior art harnesses which place the resistance on the users forefoot through perpendicular straps. In an exemplary embodiment foot harness 10 provides a heel support member which loops around the heel portion of the shoe 20, heel support member is connected to sole support member 14 of which is angular construction so that heel support member 12 may encompass the rear portion of shoe 20 with a closer fit. The attachment point support member 28 is also attached to heel support member 12, and contains a mounting surface for an attachment point 18, this provides means for foot harness 10 to be coupled to resistance, for resistance based work. FIG. 19 displays an extended front harness portion through support of mid foot support member 42, and forefoot sole support member 38, of which provides a base of support for angular harness portion 44 and multiple attachment points. Mid foot support member 42 may provide an intermediate harness portion with attachment point 18, providing load bias between the users mid foot and forefoot portions. In some embodiments, foot harness 10 may include a high friction surface 32, and may also include a multitude of attachment points 18 and support members. In some embodiments, foot harness 10 may comprise an alternate mechanical means of fastening system to locate foot harness 10 in the desired area of fitment on the users foot. In some embodiments, foot harness 10 includes a heel support member 12, which may include attachment points mounted through various means such as an angular harness portion 44 or an articulation based structure. In some embodiments, foot harness 10 may be constructed of one material type or a plurality of material types may be utilized, foot harness 10 may be constructed as one piece, or construction may consist of a plurality of pieces.

Figure 20:
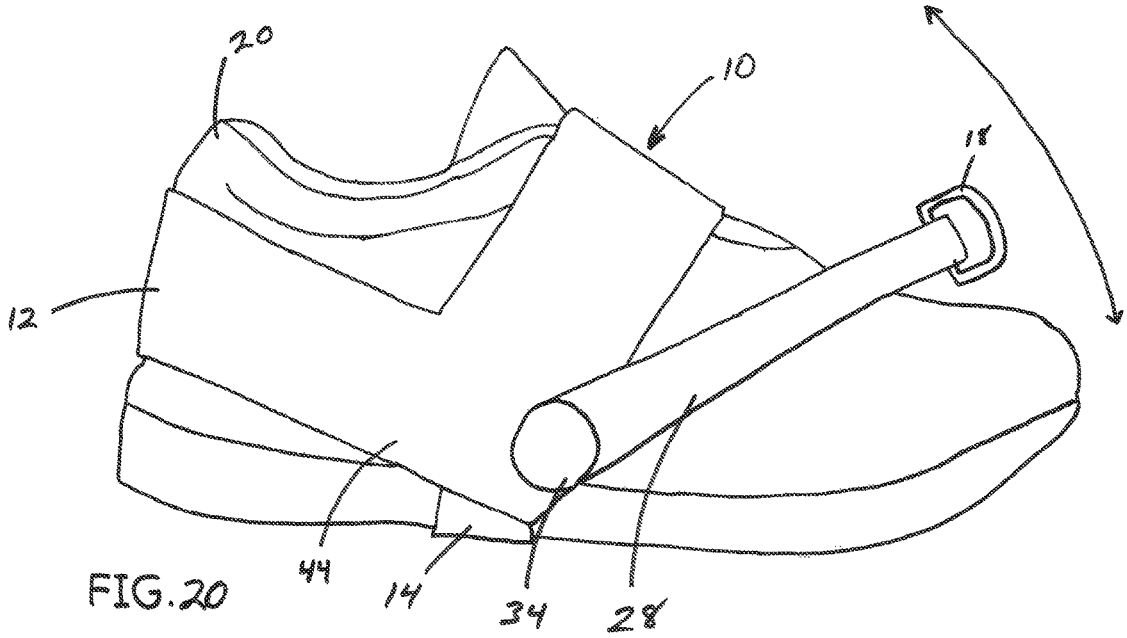
FIG. 20 is a side view of a foot harness in use with the shoe planar to the floor in accordance with an exemplary embodiment of the subject technology.

By way of example, and referring to FIG. 20, an embodiment of the subject technology comprises a foot harness 10. As will be appreciated, aspects of the foot harness 10 focus the point of resistance for resistance based work to the foot, through a pivot point 34 linked attachment point support member 28, unlike prior art harnesses which place the resistance on the users foot through straps mounted in a fixed non-adjustable construction. In an exemplary embodiment foot harness 10 includes a heel support member 12 and a sole support member 14, the heel support member 12 includes a rear portion looping around the heel of a shoe 20 and a front portion comprising attachment point support member 28 link the pivot point 34 at any angle in relation to the users shoe 20 or foot. In some embodiments, the foot harness 10 does not require a harness support member covering the shoe 20 vamp. In some embodiments, foot harness 10 may be constructed of one material type or a plurality of material types may be utilized, foot harness 10 may be constructed as one piece, or construction may consist of a plurality of pieces.

Figure 21:
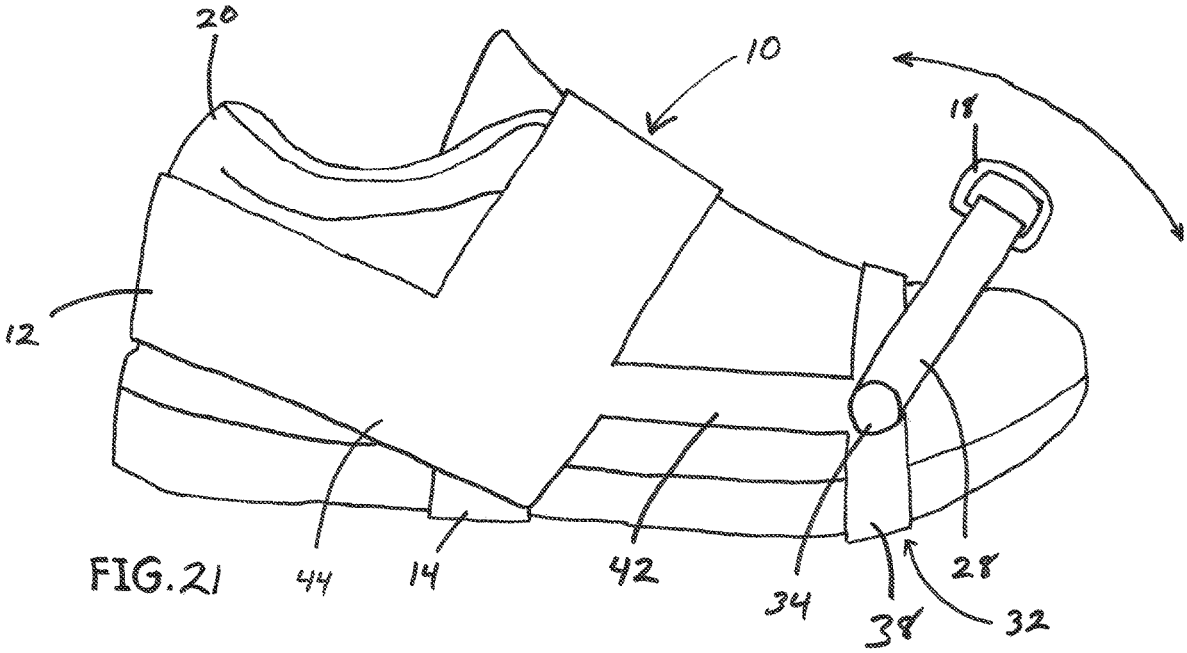
FIG. 21 is a side view of a foot harness in use with the shoe planar to the floor in accordance with an exemplary embodiment of the subject technology.

By way of example, and referring to FIG. 21, an embodiment of the subject technology comprises a foot harness 10. As will be appreciated, aspects of the foot harness 10 focus the point of resistance for resistance based exercises to the foot, through pivot point 34 linked attachment point support member 28, unlike prior art harnesses which place the resistance on the users foot through straps mounted in a fixed non-adjustable construction. In an exemplary embodiment foot harness 10 includes a heel support member 12 and a sole support member 14, the heel support member 12 includes a rear portion looping around the heel of a shoe 20, a mid foot support member 42 links the heel support member 12 to the forefoot sole support member, which comprises a pivot point 34 attachment point support member 28 link the pivot point 34 at any angle in relation to the users shoe 20 or foot. In some embodiments, the foot harness 10 does not require a harness support member covering the shoe 20 vamp. In some embodiments, foot harness 10 may be constructed of one material type or a plurality of material types may be utilized, foot harness 10 may be constructed as one piece, or construction may consist of a plurality of pieces.

Figure 22:
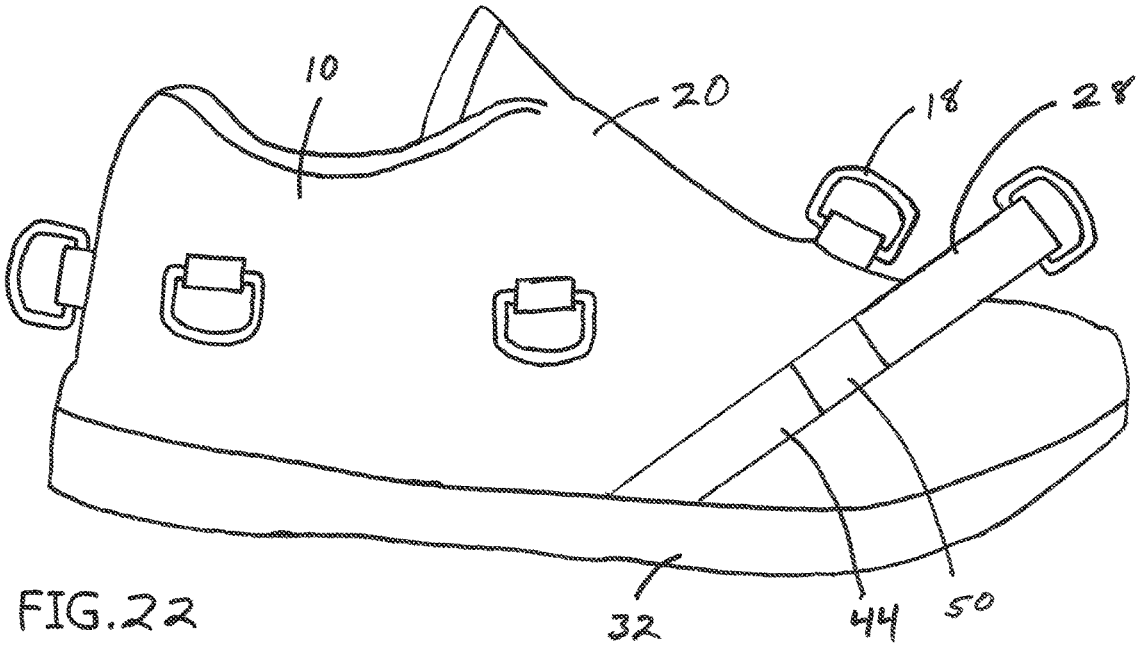
FIG. 22 is a side view of a foot harness in use with the shoe planar to the floor in accordance with an exemplary embodiment of the subject technology.
Figure 23:
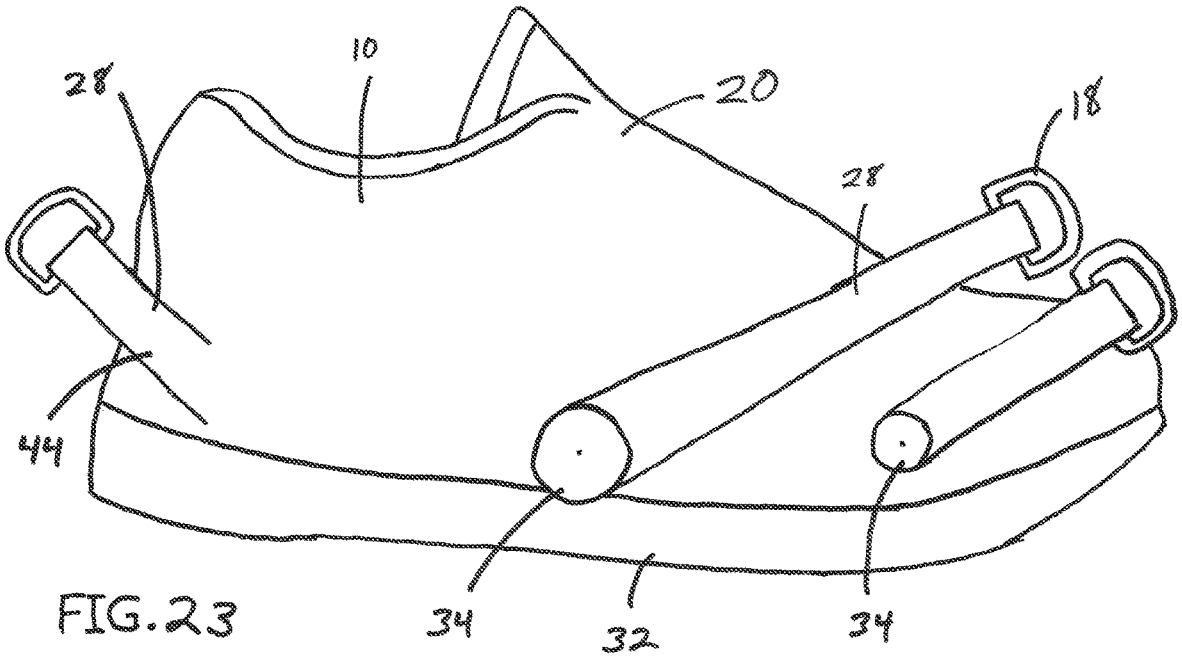
FIG. 23 is a side view of a foot harness in use with the shoe planar to the floor in accordance with an exemplary embodiment of the subject technology.

By way of example, and referring to FIGS. 22 and 23, an embodiment of the subject technology comprises a footwear 10. As will be appreciated, aspects of the footwear 10 focus the point of resistance for resistance based exercises to the foot, through the entire shell or a portion of the shell of footwear 10, unlike prior art harnesses which place the resistance on the users foot through straps encompassing the users shoe. In a exemplary embodiment footwear 10 includes a shell to encompass the sole and top portion of a users foot, attachment point 18 is mounted to the upper portion of the shoe, footwear 10 may include one pivot point 34 based attachment point 18 mounting or a multitude of them may be used for means of articulation, an angular harness portion 44 or multitude of angular harness portions 44 may also be used as a means for attachment point 18 mounting, an additional attachment point or a configuration containing a multitude of attachment point mechanisms and locations for various load bias potentials. In an exemplary embodiment, the footwear 10 includes a recording sensor 50 or may comprise a multitude of recording sensors 50 to provide means of data collection, interactive feedback, and other advanced electronic potentials. With footwear 10 a user will be able to perform desired leg resistance work in comfort, for example hip extension and flexion, lateral hip movements, leg curls and extensions, and many other movements where resistance at the foot or lower leg is preferable. Footwear 10 may utilize a configuration to suit a multitude of training or work environments. In some embodiments, footwear 10 may be configured with a leg harness support member that attaches to the leg to provide more load bias potentials, a taller footwear 10 structure such as a boot may be used to accommodate support of both the users foot and leg. In some embodiments a portion of footwear 10 may be constructed so that only a portion of foot wear 10 is utilized of which encompasses a portion of the users foot, or footwear 10 may provide a split down a seam to allow placement over the top of users foot or existing footwear. In some embodiments, foot harness 10 may be constructed of one material type or a plurality of material types may be utilized, foot harness 10 may be constructed as one piece, or construction may consist of a plurality of pieces.

Figure 24:
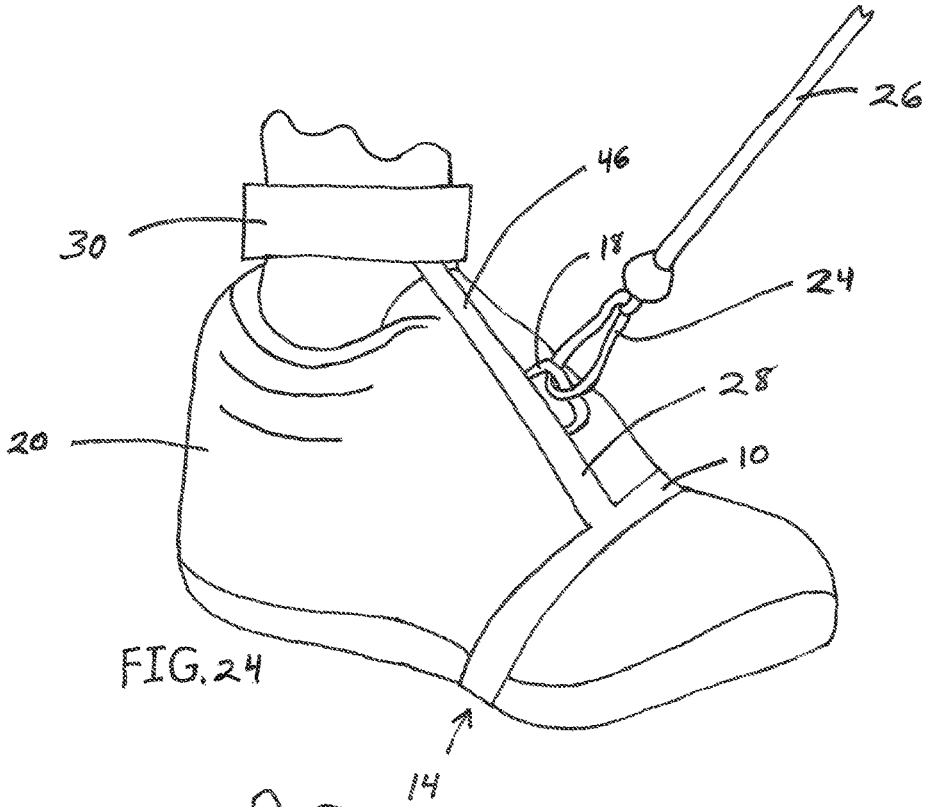
FIG. 24 is a front perspective view of a foot harness in use with the foot planar to the floor in accordance with an exemplary embodiment of the subject technology.

By way of example, and referring to FIG. 24, an embodiment of the subject technology comprises a foot harness 10. As will be appreciated, aspects of the foot harness 10 spread out the point of resistance for resistance based exercises to the foot and lower leg of the user, through a leg harness support member 30 and a sole strap 14, unlike prior art harnesses designed for resistance based exercise which are designed to place the resistance on the users foot through either a foot strap or an ankle based strap; not both. In an exemplary embodiment, the leg harness support member 30 loops around the lower leg of the user and an attachment point support member 28 projects over the top of the shoe 20 vamp and attaches to the sole strap 14, the attachment point support member 28 provides a location for the attachment point 18 to be located, this attachment point 18 location between the leg harness support member 30 and sole strap 14 provides a split load bias effect. In some embodiments the sole strap 14 may project forward to loop around the forefoot area or may include additional straps to do so. In an exemplary embodiment, when the harness 10 is worn over the users leg and shoe 20, the strap ends 28 are attached or constructed to locate above the shoe's vamp section with a fastener 18 (for example, a D-ring) is attached to a carabiner 24 of a cable 26 attached to a cable exercise machine (not shown). In some embodiments, foot harness 10 may be constructed of one material type or a plurality of material types may be utilized, foot harness 10 may be constructed as one piece, or construction may consist of a plurality of pieces.

Figure 25:
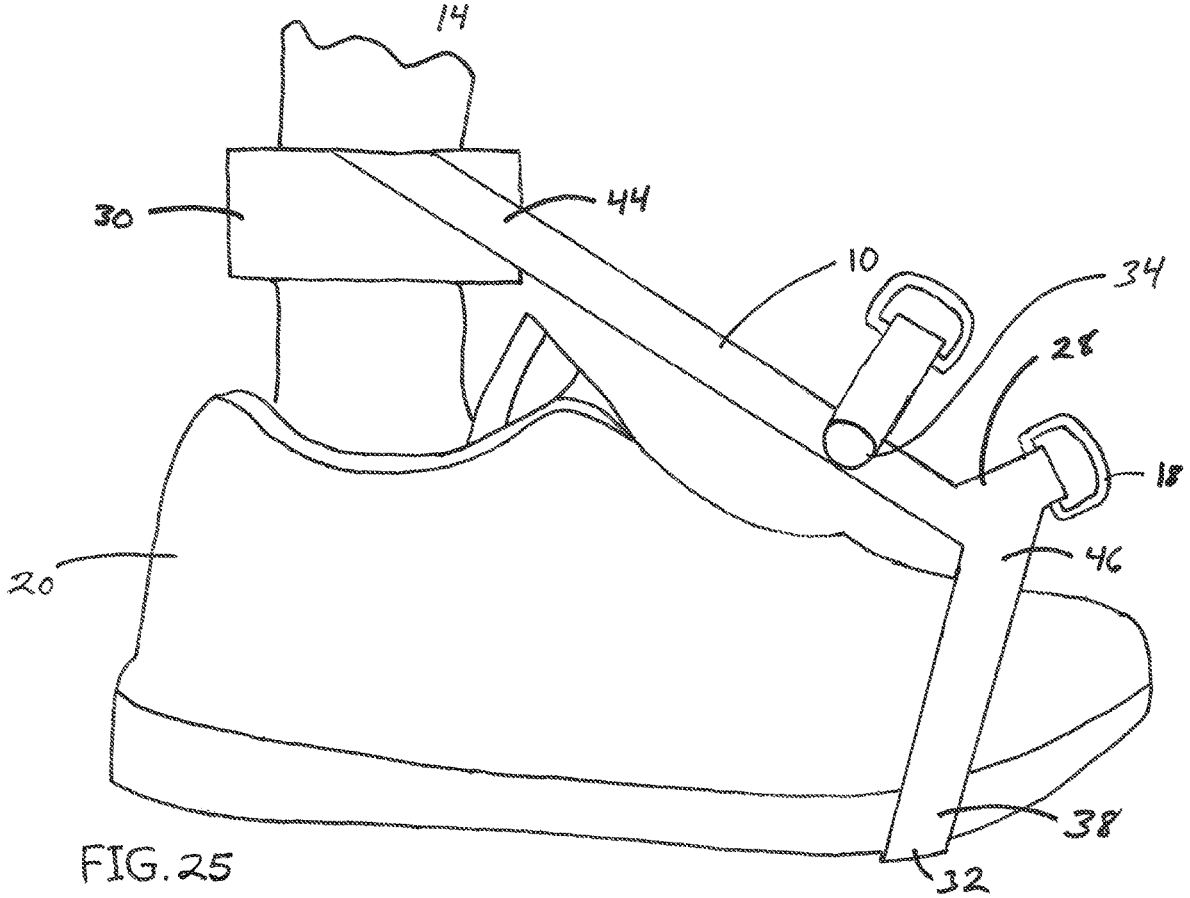
FIG. 25 is a side view of a foot harness in use with the shoe planar to the floor in accordance with an exemplary embodiment of the subject technology.
Figure 26:
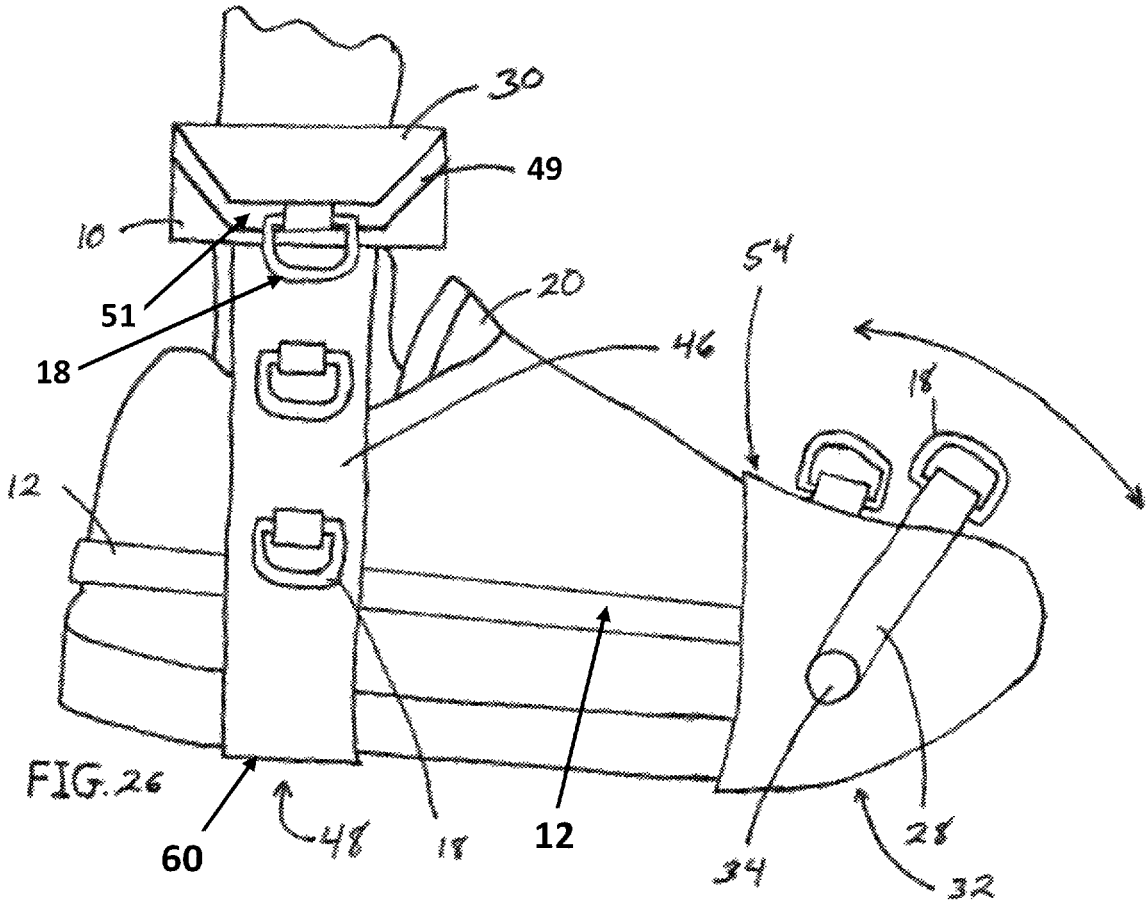
FIG. 26 is a side view of a foot harness in use with the shoe planar to the floor in accordance with an exemplary embodiment of the subject technology.
Figure 27:
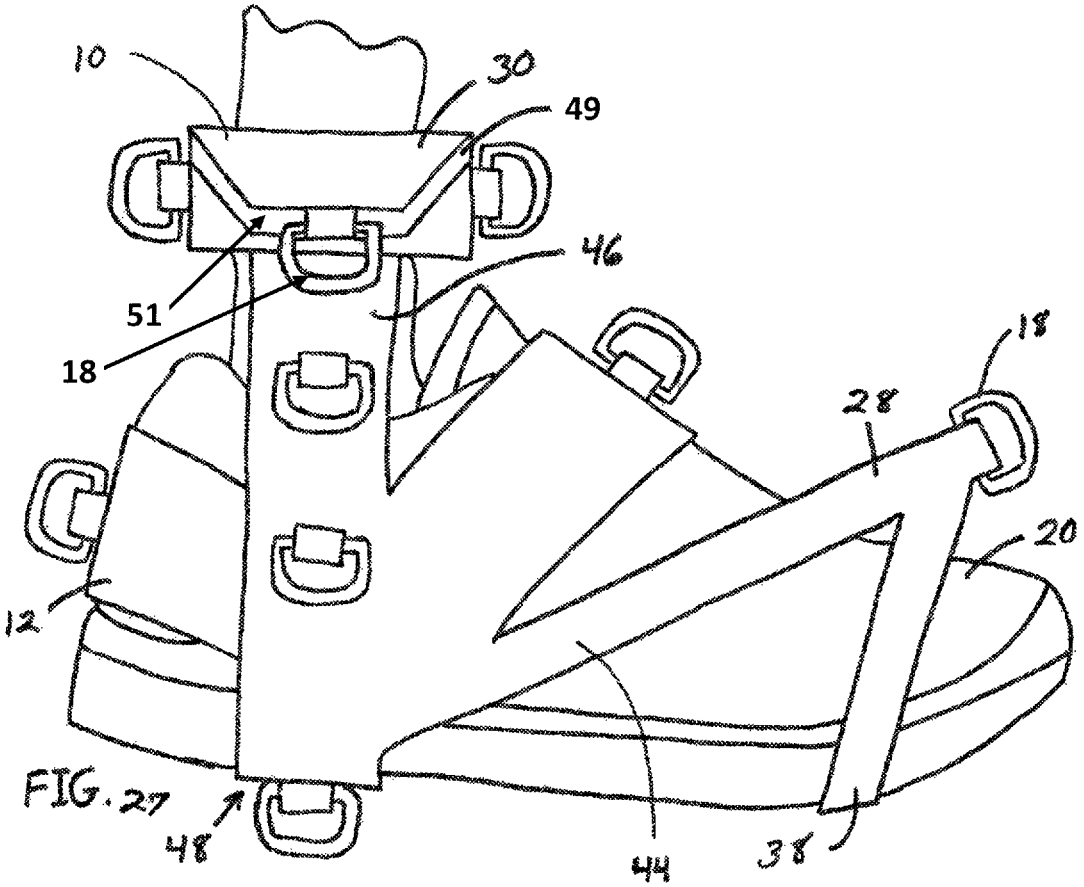
FIG. 27 is a side view of a foot harness in use with the shoe planar to the floor in accordance with an exemplary embodiment of the subject technology.

By way of example, and referring to FIGS. 25-27, an embodiment of the subject technology comprises a leg and foot harness 10 which includes a leg harness support member 30. As will be appreciated, aspects of the leg and foot harness 10 bias the point of resistance for resistance based work to the users foot and the users lower leg through an intermediate strap portion 46. This connection to both the shoe 20 or foot and users lower leg provides load bias potential with resistance based work, unlike prior art harnesses which place the resistance on the users foot or leg directly; also including perpendicular support members. A standard leg support member 30 of strictly perpendicular construction may cause an un-natural torque on the users foot or leg during use, this may also encourage the straps fastening system on the leg harness support member to fail and unexpectedly open on the user during use. The angular attachment straps 49 located on the leg harness support member 30 aid in the function and structural integrity of the straps fastening system by pulling the leg harness support member 30 to constrict a circumference thereof when a lateral load is applied to an attachment point type 18 attached to an attachment point support member 51, versus pulling it apart in the case of a standard perpendicular strap of prior art design. The attachment point support member can be fixedly attached to the leg support member perpendicular to intermediate strap portion 46, and the angular attachment straps 49 can extend angularly upwards from each end of the attachment point support member, as shown in FIGS. 26 and 27. The angular attachment straps can further project angularly upward in opposite directions from each end of the attachment point support member. When a lateral force is applied to the attachment point type attached to the attachment point support member, the angular attachment straps are simultaneously pulled laterally causing them to converge and constrict the circumference of the leg harness support member against the lower leg.

By way of example, and referring to FIGS. 1-27, an embodiment of the subject technology comprises a high friction surface which may line an interior or exterior surface of the harness support members to aid the user in maintaining a proper position and traction within the foot harness 10 during operation, or it may be incorporated into the designs exterior to allow safer use in various environments. In some embodiments an adhesive backed high friction lining is used to line the interior surface of the straps, unlike prior art fitness straps which may have a sewn in, low friction foam lining. In some embodiments the straps may be treated and/or coated to provide a high friction lining or surface. In some embodiments an attachment point 18 or other apparatus may be used as a means for connecting foot harness 10 to resistance apparatus, in some cases a more simple fabric strap or cord may be used as a point of attachment. A multitude of harness materials or hardware types may be utilized in construction or means of assembly of foot or leg harness 10 or shoe 20. In some embodiments, the foot harness 10 may be a plurality of pieces assembled together or the foot harness 10 may be constructed as one piece. In some embodiments, the foot harness 10 may have support members constructed of fabric strap, or other flexible material. In some embodiments, foot harness 10 may be constructed of one material type or a plurality of material types may be utilized, foot harness 10 may be constructed as one piece, or construction may consist of a plurality of pieces.

What is claimed is:

1. A leg harness, configured to support a foot during resistance based work, comprising:

a rear sole support member that is configured to loop under a portion of a sole of the foot;

a leg harness support member, configured to be placed around a lower leg;

an intermediate strap portion that extends to the leg harness support member from the rear sole support member and attaches to the leg harness support member on lateral sides of the leg support member;

an elongated attachment point support member fixedly attached to the leg harness support member perpendicular to the intermediate strap portion and having lateral end points;

one or more angular attachment straps fixedly attached to the leg harness support member to extend angularly upwards from each lateral end point of the attachment point support member; and at least one attachment point, configured to be attached to a means of resistance, operably connected to the attachment point support member, such that, when a lateral force is applied to the attachment point type by the means of resistance attached thereto, the attachment point support member simultaneously pulls the one or more angular attachment straps causing them to converge to constrict a circumference of the leg harness support member around the lower leg.

2. The leg harness according to claim 1, further comprising an angular harness portion extending at an angle from the rear sole support member and configured to project forward of the foot.

3. The leg harness as in any one of the preceding claims, wherein the rear sole support member further comprises a flattened bottom section, configured to be positioned under the sole of the foot.

4. The leg harness as in any one of the preceding claims, further comprising a heel support member configured to loop around a heel of the foot.

5. The leg harness according to claim 4, wherein the heel support member is adjustable.

6. The leg harness according to claim 5, wherein the heel support member comprises releasable mating surfaces.

7. The leg harness according to claim 4, wherein the heel support member extends from the intermediate strap portion at an angle towards the leg harness support member.

8. The leg harness according to claim 4, wherein the heel support member extends forward of the intermediate strap portion to attach to a foot sleeve support member configured to encompass a forefoot or toe section of the foot.

9. The leg harness according to claim 8, further comprising a plurality of attachment points on the foot sleeve support member, configured to be attached to a means of resistance, for load distribution.

10. The leg harness according to claim 9, further comprising at least one pivot point arranged to enable articulation of the at least one attachment point of the foot sleeve support member.

11. The leg harness as in any one of the preceding claims, further comprising one or more attachment points on at least one of a front, a back, and a side of the leg harness support member.

12. The leg harness as in any one of the preceding claims, further comprising at least one attachment point on the heel support member.

13. The leg harness as in any one of the preceding claims, further comprising at least one high friction surface, configured to resist slipping of the foot during resistance based work.

14. The leg harness, according to any one of the preceding claims, wherein at least one attachment point is adjacent to the leg harness support member.

15. The leg harness according to claim 1, further comprises a fastening system for adjustment of the leg harness.

16. A method for supporting a leg and heel of a foot during resistance based work, the method comprising:

obtaining a leg harness, according to claim 1;

positioning the rear sole support member to loop under the heel of the foot;

positioning the leg harness support member around the lower leg, whereby the intermediate strap portion axially connects the heel to the lower leg;

such that, when a means of resistance based work is attached to the at least one attachment point on the attachment point support member and the foot and lower leg are exerted laterally against the means of resistance based work the angular attachment straps converge against the leg harness support member and constrict a circumference thereof.

17. The method according to claim 16, wherein the leg harness further comprises a fastening system, and the method further comprises utilizing the fastening system to adjust the leg harness.

18. The method according to claim 16, further comprising an attachment points on at least one of a front, a back, and a side of the leg harness support member and the method further comprises attaching at least one of the attachment points to the means of resistance based work.

* * * * *